US011648553B2

(12) United States Patent
Megaridis et al.

(10) Patent No.: US 11,648,553 B2
(45) Date of Patent: May 16, 2023

(54) WETTABILITY-PATTERNING METHOD AND DESIGNS FOR PUMPLESS TRANSPORT AND PRECISE MANIPULATION OF LIQUID VOLUMES ON AND THROUGH POROUS MATERIALS

(71) Applicants: KIMBERLY-CLARK WORLDWIDE, INC., Neenah, WI (US); The Board of Trustees of the University of Illinois, Urbana, IL (US)

(72) Inventors: Constantine Megaridis, Oak Park, IL (US); Souvick Chatterjee, Chicago, IL (US); Ali Ibrahim, Chicago, IL (US); Pallab Sinha Mahapatra, Chicago, IL (US); Ranjan Ganguly, Chicago, IL (US); Lisha Yu, Appleton, WI (US); Richard N. Dodge, Appleton, WI (US)

(73) Assignees: KIMBERLY-CLARK WORLDWIDE, INC., Neenah, WI (US); The Board of Trustees of the University of Illinois, Urbana, IL (US)

( * ) Notice: Subject to any disclaimer, the term of this patent is extended or adjusted under 35 U.S.C. 154(b) by 631 days.

(21) Appl. No.: 16/349,379

(22) PCT Filed: Nov. 16, 2017

(86) PCT No.: PCT/US2017/061912
§ 371 (c)(1),
(2) Date: May 13, 2019

(87) PCT Pub. No.: WO2018/093982
PCT Pub. Date: May 24, 2018

(65) Prior Publication Data

US 2019/0262825 A1 Aug. 29, 2019

Related U.S. Application Data

(60) Provisional application No. 62/423,802, filed on Nov. 18, 2016.

(51) Int. Cl.
*B01L 3/00* (2006.01)

(52) U.S. Cl.
CPC ... *B01L 3/50273* (2013.01); *B01L 2200/0605* (2013.01); *B01L 2300/0816* (2013.01);
(Continued)

(58) Field of Classification Search
CPC ..... B01L 3/50273; B01L 2200/0605; B01L 2300/0816; B01L 2300/165;
(Continued)

(56) References Cited

U.S. PATENT DOCUMENTS 8,034,990 B2 10/2011 Berland et al.
2006/0159592 A1 7/2006 Andersson et al.
(Continued)

FOREIGN PATENT DOCUMENTS

CN 103747965 A 4/2014
CN 104437691 A 3/2015
(Continued)

OTHER PUBLICATIONS

Rodriguez et al. "Paper-Based RNA Extraction, in Situ Isothermal Amplification, and Lateral Flow Detection for Low-Cost, Rapid Diagnosis of Influenza A (H1N1) from Clinical Specimens" Anal. Chem. 2015, 87, 15, 7872-7879 (Year: 2015).*
(Continued)

*Primary Examiner* — Benjamin R Whatley
*Assistant Examiner* — Quocan B Vo
(74) *Attorney, Agent, or Firm* — Kimberly-Clark Worldwide, Inc.

(57) ABSTRACT

A material for manipulating liquid includes a porous substrate having first and second surfaces; and a wedge-shaped transport element disposed on one of the first and second surfaces, wherein the wedge-shaped transport element has a narrow end and a wide end, the wide end connected to a first
(Continued)

reservoir, wherein the wedge-shaped transport element is configured to pass liquid from the narrow end to the wide end to the first reservoir, regardless of gravity, and wherein the first reservoir is configured to pass liquid away from the substrate in a z-direction opposite from the surface on which a liquid is deposited. The surface on which the wedge-shaped transport element is disposed is one of hydrophobic or superhydrophobic, and the wedge-shaped transport element is one of a) superhydrophilic when the first surface is hydrophobic, b) superhydrophilic when the first surface is superhydrophobic, and c) hydrophilic when the first surface is superhydrophobic.

12 Claims, 4 Drawing Sheets

(52) U.S. Cl.
CPC ... *B01L 2300/165* (2013.01); *B01L 2300/166* (2013.01); *B01L 2400/0406* (2013.01)

(58) Field of Classification Search
CPC ..... B01L 2300/166; B01L 2400/0406; B01L 3/502792; B01L 2400/04; B01L 2300/12; B01L 2300/0848; B01L 2300/0861; B01L 3/00
See application file for complete search history.

(56) References Cited

U.S. PATENT DOCUMENTS

| | | | | |
|---|---|---|---|---|
| 2009/0241640 | A1 | 10/2009 | Kallmes | |
| 2010/0145294 | A1 | 6/2010 | Song et al. | |
| 2011/0033663 | A1 | 2/2011 | Svec et al. | |
| 2011/0123398 | A1 | 5/2011 | Carrilho et al. | |
| 2011/0209999 | A1* | 9/2011 | Sibbett | G01N 27/4473 204/451 |
| 2011/0286896 | A1 | 11/2011 | Hess et al. | |
| 2012/0118392 | A1* | 5/2012 | Blankenstein | B01L 3/502738 137/1 |
| 2012/0168309 | A1 | 7/2012 | Heikenfeld et al. | |
| 2012/0192952 | A1 | 8/2012 | Shen et al. | |
| 2013/0081698 | A1 | 4/2013 | Lee et al. | |
| 2013/0095506 | A1 | 4/2013 | Bhandari et al. | |
| 2014/0018263 | A1 | 1/2014 | Levkin et al. | |
| 2014/0288515 | A1 | 9/2014 | Pan et al. | |
| 2014/0360252 | A1 | 12/2014 | Yamamoto et al. | |
| 2015/0132742 | A1 | 5/2015 | Thuo et al. | |
| 2015/0283003 | A1 | 10/2015 | Rosati et al. | |
| 2016/0038937 | A1* | 2/2016 | Ding | G01N 33/558 435/7.92 |
| 2016/0169867 | A1 | 6/2016 | Khine et al. | |
| 2016/0199832 | A1 | 7/2016 | Jamshidi et al. | |
| 2018/0178212 | A1* | 6/2018 | Roxhed | G01N 1/4077 |

FOREIGN PATENT DOCUMENTS

| | | | |
|---|---|---|---|
| CN | 105776125 | A | 7/2016 |
| CN | 105833926 | A | 8/2016 |
| CN | 105854964 | A | 8/2016 |
| RU | 45733 | U1 | 5/2005 |
| RU | 2473428 | C1 | 1/2013 |
| RU | 2521639 | C2 | 7/2014 |
| WO | 9856326 | A1 | 12/1998 |
| WO | 12078066 | A2 | 6/2012 |
| WO | 15112635 | A1 | 7/2015 |

OTHER PUBLICATIONS

Mendez et al. "Imbibition in Porous Membranes of Complex Shape: Quasi-stationary Flow in Thin Rectangular Segments" Langmuir 2010, 26, 2, 1380-1385 (Year: 2010).*

Wang et al. "Paper pump for passive and programmable transport" Biomicrofluidics 7, 014107 (2013) (Year: 2013).*

Huang, Shuai et al., "Underwater Spontaneous Pumpless Transportation of Nonpolar Organic Liquids on Extreme Wettability Patterns," ACS Applied Materials & Interfaces, Jan. 20, 2016, vol. 8, No. 5, pp. 2942-2949.

Li, Xiao et al., "Fabrication of three-dimensional microfluidic channels in a single layer of cellulose paper", Microfluidics and nanofluidics 16, No. 5 (2014): 819-827).

* cited by examiner

WETTABILITY-PATTERNING METHOD AND DESIGNS FOR PUMPLESS TRANSPORT AND PRECISE MANIPULATION OF LIQUID VOLUMES ON AND THROUGH POROUS MATERIALS

BACKGROUND

Liquid transport using wettability-patterned surfaces is an applicative and growing field in microfluidics. The simplicity of material fabrication combined with open-surface flow is promising for low-cost microfluidic applications. Tuning material wettability (spatially) to control liquid-solid interaction towards a specific microfluidic task is relevant not only to impervious (rigid as well as flexible) substrates, but also porous and fibrous substrates. Previous work has demonstrated unidirectional fluid transport using special coating technique that created a wettability gradient along the thickness of the fibrous substrate through selectively different exposure levels of ultraviolet (UV) radiation. The operation of such porous membrane, fabric or paper, featuring wettability gradients is dependent on the penetration resistance through such materials; this resistance arises from the coupling effect of local geometric angle of adjacent fibers and solid-liquid contact angle. The unidirectional transport is based on the fundamental observation that the penetration pressure to transport liquid from the hydrophilic to the hydrophobic side is much greater than the pressure required to force liquid in the opposite direction.

Functioning of these (frequently paper-based) devices relies heavily on how the porous substrate regulates liquid flow in a preferred direction, while inhibiting the same in the reverse direction. Classically, interaction of liquids with air and solid has been investigated as a rich three-phase contact line problem. Surface modification rendering hydrophobicity or hydrophilicity to the substrate creates wettability patterns that provide useful applications for open-surface liquid transport. Water droplet transport on superhydrophobic tracks using external forces like gravity or electrostatic forces has been shown. Surface-tension confined tracks possess the ability to pumplessly transport low surface tension liquids without the use of an external force. While several prior designs have attempted to establish controlled, unidirectional liquid transport either on the surface of the fibrous substrate, or through the thickness of the porous material, combining these two modes of controlled, unidirectional transport has not been demonstrated.

SUMMARY

Porous materials have the inherent ability to transport liquid using the wicking principle. A combination of this principle along with wettability patterning facilitates guided transport on porous substrates, which has been shown to have useful applications for fabricating low-cost diagnostic devices for the developing world.

A superhydrophilic treatment on the bottom and/or top of a superhydrophobic substrate material, in wedge-shaped patterns, can direct liquid flow to occur in the x-y plane on the top and/or bottom of the substrate, as well as through the z-direction, away from the insult point. This was demonstrated on High Density Paper Towel (HDPT) with relatively low liquid feed rates.

The present disclosure describes transport of metered volumes of liquid on porous, permeable substrates. Liquid manipulation with faster lateral and transverse transport in desired regions of a paper towel using different wettability designs is demonstrated. The designs of the present disclosure can apply these wettability contrast designs on any substrates (paper/nonwovens), as long as there is a transverse permeability. Specifically, designs are demonstrated using high density paper towel (HDPT), a substrate chosen because of its ease of availability. The methodology discussed in this disclosure uses this directional transport in a unique way, providing more control over the diode nature of porous substrates. The fabrication process is very simple and different design modules can be realized with minor modifications, leading to different applications. Wettability features are integrated to increase transport rate on different fundamental design modules. The concept can be used with any fibrous assembly including paper- and cloth-based substrates.

The present disclosure relates to a material for manipulating liquid volumes includes a porous substrate having first and second surfaces; and a wedge-shaped transport element disposed on one of the first and second surfaces, wherein the wedge-shaped transport element has a narrow end and a wide end, wherein the wide end is connected to a first reservoir, wherein the wedge-shaped transport element is configured to pass liquid from the narrow end to the wide end to the first reservoir, regardless of gravity, and wherein the first reservoir is configured to pass liquid away from the substrate in a z-direction opposite from the surface on which a liquid is deposited, wherein the surface on which the wedge-shaped transport element is disposed is one of hydrophobic or superhydrophobic, and wherein the wedge-shaped transport element is one of a) superhydrophilic when the first surface is hydrophobic, b) superhydrophilic when the first surface is superhydrophobic, and c) hydrophilic when the first surface is superhydrophobic.

The present disclosure also relates to a material for manipulating liquid volumes includes a porous substrate having first and second surfaces; and a wedge-shaped transport element disposed on the second surface, wherein the wedge-shaped transport element has a narrow end and a wide end, wherein the wide end is connected to a reservoir disposed on the second surface, wherein the wedge-shaped transport element is configured to pass liquid from the narrow end to the wide end to the reservoir, regardless of gravity, and wherein the reservoir is configured to pass liquid away from the substrate in a z-direction opposite from the surface on which a liquid is deposited, wherein the second surface is one of hydrophobic or superhydrophobic, and wherein the wedge-shaped transport element is one of a) superhydrophilic when the first surface is hydrophobic, b) superhydrophilic when the first surface is superhydrophobic, and c) hydrophilic when the first surface is superhydrophobic.

The present disclosure also relates to a material for manipulating liquid volumes includes a porous substrate having first and second surfaces, wherein the first surface includes a treatment rendering the first surface hydrophobic or superhydrophobic; and a wedge-shaped transport element disposed on the second surface, wherein the wedge-shaped transport element has a narrow end and a wide end, wherein the wide end is connected to a reservoir disposed on the second surface, wherein the substrate is configured to receive liquid on the first surface opposite the narrow end of the wedge-shaped transport element, wherein the wedge-shaped transport element is configured to pass liquid from the narrow end to the wide end to the reservoir, regardless of gravity, and wherein the reservoir is configured to pass liquid away from the substrate in a z-direction opposite from the surface on which a liquid is deposited, wherein the wedge-shaped transport element is one of a) superhydrophilic when the first surface is hydrophobic, b) superhydrophilic when the first surface is superhydrophobic, and c) hydrophilic when the first surface is superhydrophobic.

BRIEF DESCRIPTION OF THE FIGURES

The foregoing and other features and aspects of the present disclosure and the manner of attaining them will become more apparent, and the disclosure itself will be better understood by reference to the following description, appended claims and accompanying drawings, where:

Figure 1:
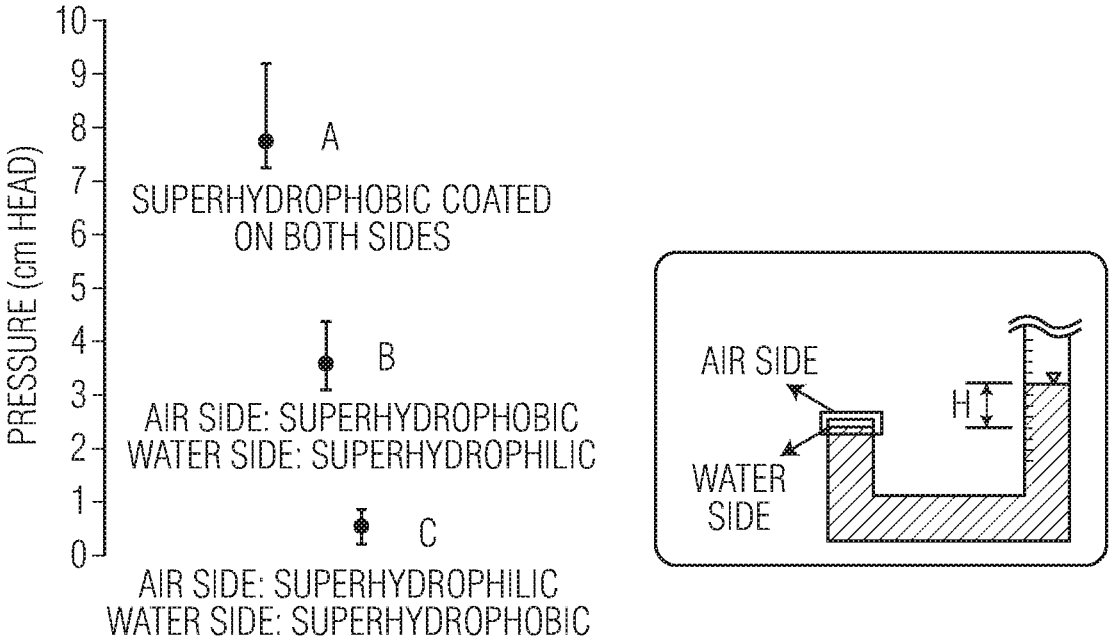
FIG. 1 graphically illustrates hydrostatic pressure heads as measured for different coated-HDPT conditions.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

All percentages are by weight of the total solid composition unless specifically stated otherwise. All ratios are weight ratios unless specifically stated otherwise.

The term "superhydrophobic" refers to the property of a surface to repel water very effectively. This property is quantified by a water contact angle (CA) exceeding 150°.

The term "hydrophobic," as used herein, refers to the property of a surface to repel water with a water contact angle from about 90° to about 120°.

The term "hydrophilic," as used herein, refers to surfaces with water contact angles well below 90°.

As used herein, the term "nonwoven web" or "nonwoven fabric" means a web having a structure of individual fibers or threads that are interlaid, but not in an identifiable manner as in a knitted web. Nonwoven webs have been formed from many processes, such as, for example, meltblowing processes, spunbonding processes, air-laying processes, coforming processes and bonded carded web processes. The basis weight of nonwoven webs is usually expressed in ounces of material per square yard (osy) or grams per square meter (gsm) and the fiber diameters are usually expressed in microns, or in the case of staple fibers, denier. It is noted that to convert from osy to gsm, osy must be multiplied by 33.91.

As used herein the term "spunbond fibers" refers to small diameter fibers of molecularly oriented polymeric material. Spunbond fibers can be formed by extruding molten thermoplastic material as fibers from a plurality of fine, usually circular capillaries of a spinneret with the diameter of the extruded fibers then being rapidly reduced as in, for example, U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al. Spunbond fibers are generally not tacky when they are deposited onto a collecting surface and are generally continuous. Spunbond fibers are often about 10 microns or greater in diameter. However, fine fiber spunbond webs (having an average fiber diameter less than about 10 microns) can be achieved by various methods including, but not limited to, those described in commonly assigned U.S. Pat. No. 6,200,669 to Marmon et al. and U.S. Pat. No. 5,759,926 to Pike et al.

Meltblown nonwoven webs are prepared from meltblown fibers. As used herein, the term "meltblown fibers" means fibers formed by extruding a molten thermoplastic material through a plurality of fine, usually circular, die capillaries as molten threads or filaments into converging high velocity, usually hot, gas (e.g. air) streams that attenuate the filaments of molten thermoplastic material to reduce their diameter, which can be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers are microfibers that can be continuous or discontinuous, are generally smaller than 10 microns in average diameter (using a sample size of at least 10), and are generally tacky when deposited onto a collecting surface.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "multicomponent fibers" refers to fibers or filaments that have been formed from at least two polymers extruded from separate extruders but spun together to form such fibers. Multicomponent fibers are also sometimes referred to as "conjugate" or "bicomponent" fibers or filaments. The term "bicomponent" means that there are two polymeric components making up the fibers. The polymers are usually different from each other, although conjugate fibers can be prepared from the same polymer, if the polymer in each state is different from the other in some physical property, such as, for example, melting point, glass transition temperature, or softening point. In all cases, the polymers are arranged in purposefully positioned distinct zones across the cross-section of the multicomponent fibers or filaments and extend continuously along the length of the multicomponent fibers or filaments. The configuration of such a multicomponent fiber can be, for example, a sheath/core arrangement, wherein one polymer is surrounded by another, a side-by-side arrangement, a pie arrangement or an "islands-in-the-sea" arrangement. Multicomponent fibers are taught in U.S. Pat. No. 5,108,820 to Kaneko et al.; U.S. Pat. No. 5,336,552 to Strack et al.; and U.S. Pat. No. 5,382,400 to Pike et al. For two component fibers or filaments, the polymers can be present in ratios of 75/25, 50/50, 25/75 or any other desired ratios.

As used herein, the term "substantially continuous fibers" is intended to mean fibers that have a length that is greater than the length of staple fibers. The term is intended to include fibers that are continuous, such as spunbond fibers, and fibers that are not continuous, but have a defined length greater than about 150 millimeters.

As used herein, the term "staple fibers" means fibers that have a fiber length generally in the range of about 0.5 to about 150 millimeters. Staple fibers can be cellulosic fibers or non-cellulosic fibers. Some examples of suitable non-cellulosic fibers that can be used include, but are not limited to, polyolefin fibers, polyester fibers, nylon fibers, polyvinyl acetate fibers, and mixtures thereof. Cellulosic staple fibers include for example, pulp, thermomechanical pulp, synthetic cellulosic fibers, modified cellulosic fibers, and the like. Cellulosic fibers can be obtained from secondary or recycled sources. Some examples of suitable cellulosic fiber sources include virgin wood fibers, such as thermomechanical, bleached, and unbleached softwood and hardwood pulps. Secondary or recycled cellulosic fibers can be obtained from office waste, newsprint, brown paper stock, paperboard scrap, etc., can also be used. Further, vegetable fibers, such as abaca, flax, milkweed, cotton, modified cotton, cotton linters, can also be used as the cellulosic fibers. In addition, synthetic cellulosic fibers such as, for example, rayon and viscose rayon can be used. Modified cellulosic fibers are generally composed of derivatives of cellulose formed by substitution of appropriate radicals (e.g., carboxyl, alkyl, acetate, nitrate, etc.) for hydroxyl groups along the carbon chain.

As used herein, the term "pulp" refers to fibers from natural sources, such as woody and non-woody plants. Woody plants include, for example, deciduous and coniferous trees. Non-woody plants include, for example, cotton, flax, esparto grass, milkweed, straw, jute, hemp, and bagasse.

As used herein, "tissue products" are meant to include facial tissue, bath tissue, towels, napkins, and the like. The present disclosure is useful with tissue products and tissue paper in general, including but not limited to conventionally felt-pressed tissue paper, high bulk pattern densified tissue paper, and high bulk, uncompacted tissue paper.

Controlled transport of liquid in porous materials can have many applications. Applying the technologies described herein allows for more efficient use of materials in a product, which results in cost savings and better product performance.

Such efficiencies are achieved through pumpless and directional liquid transport in three dimensions (x, y, z) within porous materials. This technology allows liquid volumes that are deposited on one side of a porous material to be dispensed from another location on the opposite side of that material and at a distance from the original deposition site. The technology uses specific patterns of hydrophilic, superhydrophilic, hydrophobic, and superhydrophobic materials as described herein.

The solution of the present disclosure is new because, in contrast to standard wicking mechanisms that transport liquid through a porous substrate, the technology described herein leverages wettability-contrast patterns on the surface to invoke Laplace pressure gradients to transport liquid directionally along the upper or lower surface of the porous substrate. In addition, by implementing a widened patch of a hydrophilic or superhydrophilic region or reservoir, the liquid is disposed from the substrate at a desired location away from the original deposition site.

Without committing to a specific theory, it is believed that liquid transport is aided by the hydrophobicity/hydrophilicity difference between the porous substrate and the liquid-manipulating pattern. For example, if the porous substrate is inherently or treated to be superhydrophobic, the liquid-manipulating pattern can be either hydrophilic or superhydrophilic. Similarly, if the porous substrate is inherently or treated to be hydrophobic, the liquid-manipulating pattern should be superhydrophilic. It is not necessary for the hydrophobicity/hydrophilicity difference to be between superhydrophobicity and superhydrophilicity.

Liquid can be transported either along the top of and then through a porous substrate, or through and then along the bottom of a porous substrate. The designs feature liquid-dispensing ability from a desired location. In one aspect, liquid is transported only along the bottom surface, keeping the top surface dry.

The liquid to be transported can be any liquid as long as the corresponding surface features both wettable and non-wettable domains with respect to this specific liquid. For example, the liquid can be water or alcohol. The liquid can be a refrigerant or a biological sample. The biological sample can be blood, plasma, urine, or any tissue dissolved or dispersed in a liquid or solvent. The liquid can be any biochemical agent dissolved or dispersed in a liquid solvent. Biochemical agents can include but are not limited to biomarkers, proteins, nucleic acids, pathogens, drugs, and/or toxins. The liquid can be oil or a liquid propellant. The liquid can have a high surface tension, whereby a higher surface tension corresponds to a faster transport speed. The liquid can be aqueous or non-aqueous.

A liquid, after coming in contact with a porous material, needs to overcome a penetration pressure to emerge from the other side. Substrates requiring a lower penetration pressure facilitate this liquid permeation. To quantify the penetration pressure required for achieving z-directional transport across an HDPT, a standard hydrohead measurement was carried out. The hydrohead H quantifies the penetration pressure, as shown in the inset of FIG. 1.

By making the porous substrate superhydrophobic, the porous substrate can be made to withstand a finite hydrostatic pressure before the liquid starts penetrating across the thickness of the porous substrate to the non-treated absorbent side. The pressure that the substrate can withstand before the liquid penetrates is dependent at least in part on whether superhydrophobic solution is sprayed on one or both sides of the substrate. FIG. 1 shows the hydrohead measurement (H) for three different coating configurations of the HDPT. When both sides are coated to become superhydrophobic, the penetration pressure is the greatest, as observed in the top most data point in FIG. 1 (case A). When the liquid encounters the superhydrophobic coating first, penetration to the other side occurs at low H (case C). Higher penetration pressure is achieved when liquid encounters the substrate first from the superhydrophilic side (case B). The transverse movement spreads the liquid laterally on the air-side surface for case C in FIG. 1.

Figure 2:
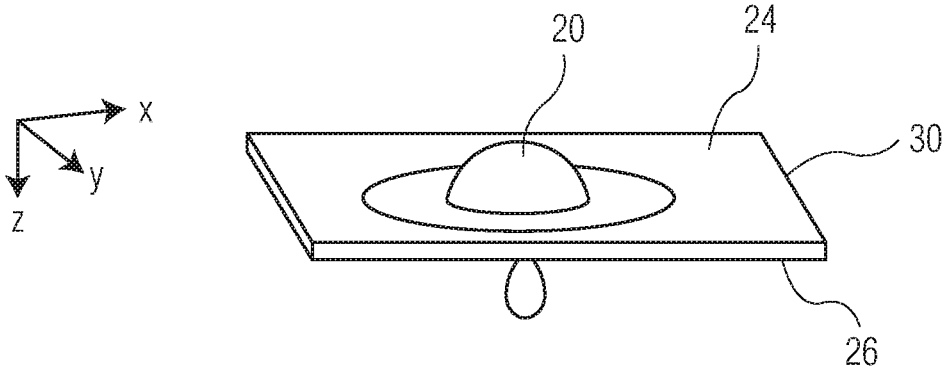
FIG. 2 schematically illustrates that when a water droplet is dispensed on the superhydrophobic-coated side of the horizontal HDPT, the liquid penetrates after a few seconds and spreads radially on the bottom surface, which is superhydrophilic.

As illustrated in FIG. 2, when a water droplet 20 is dispensed on the superhydrophobic-coated top surface 24 of HDPT 30, the liquid penetrates after a few seconds and spreads radially on the bottom surface 26, which is not coated and is thus superhydrophilic.

Figure 3:
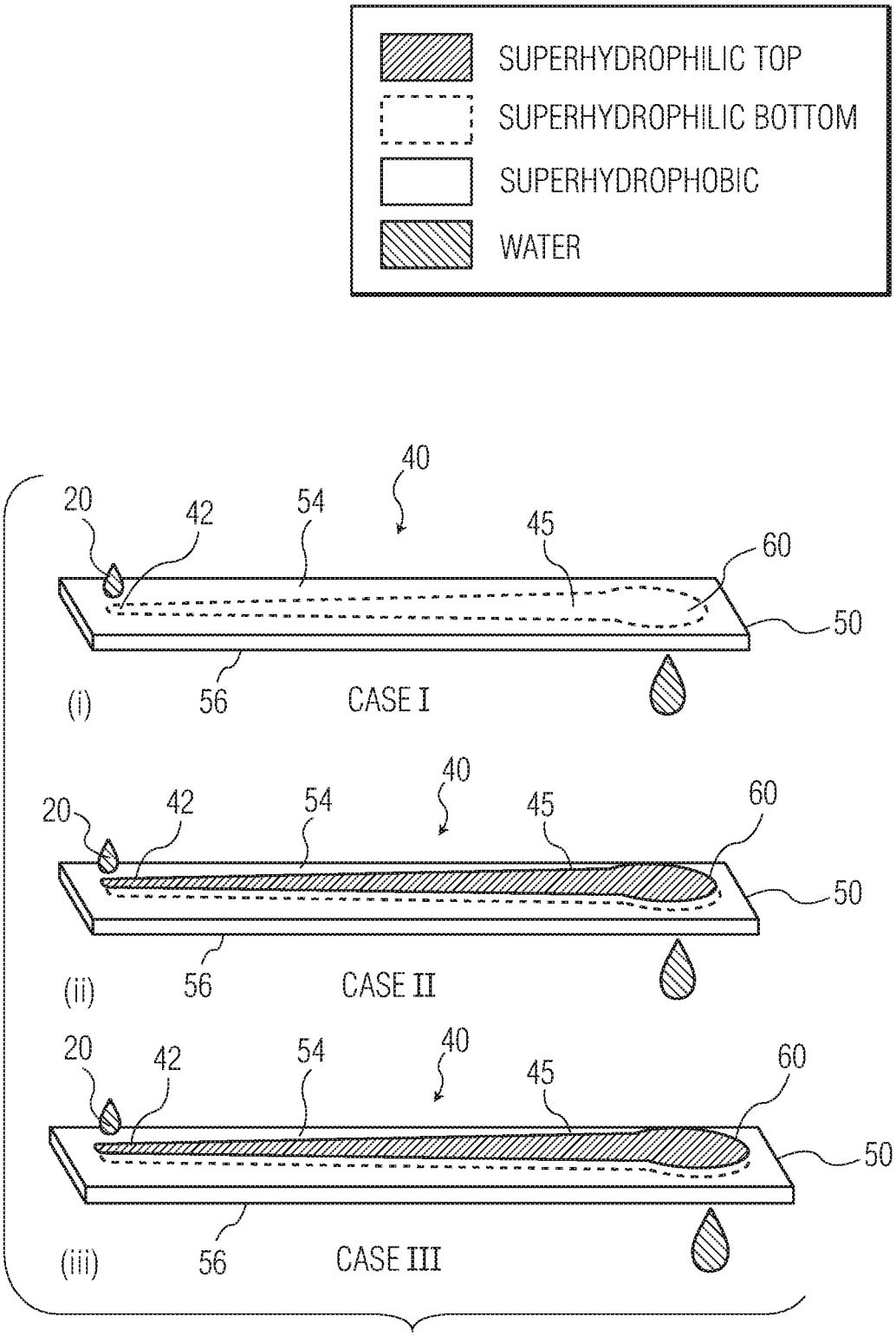
FIG. 3 graphically illustrates three different design configurations based on the position of the wedge on the HDPT: Case I shows a configuration where the wettable wedge-shaped transport element, with a circular reservoir, is laid at the bottom of the HDPT, Case II shows the wettable wedge-shaped transport element and the reservoir laid on the top side of HDPT with a wettable reservoir at the bottom, and Case III shows wettable wedge-shaped transport elements and reservoirs laid back to back on both sides of the HDPT.

FIG. 3 illustrates one transport element 40 of a wettability-contrast pattern disposed on the surface of a substrate 50 that has been treated to be superhydrophobic. The substrate 50 has two opposing surfaces: a first surface 54 that is configured to receive a liquid and a second surface 56 that is configured to distribute a liquid. The transport element 40 is generally wedge shaped with a narrow end 42 and a wide end 45. A reservoir 60 is a wider portion disposed at the wide end 42 of the transport element 40 and in liquid communication with the transport element 40. The transport element 40 and the reservoir 60 are treated or otherwise established to be superhydrophilic. The narrow end 42 of the transport element 40 is positioned such that liquid 20 is deposited on the transport element 40 at the narrow end 42.

Three arrangements are illustrated in FIG. 3. In Case I, the first surface 54 is the top surface and is superhydrophobic. A superhydrophilic transport element 40 is disposed on the second or bottom surface 56 with a superhydrophobic background. Liquid 20 is deposited on the first surface 54 at a point opposite the narrow end 42 of the transport element 40. The liquid passes through the substrate 50 to emerge through the narrow end 42 of the transport element 40. A Laplace pressure gradient is invoked to transport liquid directionally along the transport element 40 to the reservoir 60 also positioned on the bottom surface 56. The liquid is then distributed through gravity-aided pinch-off from the substrate at the reservoir 60, which is at a location removed from the deposition site.

In Case II, a superhydrophilic transport element 40 and reservoir 60 are disposed on the first or top surface 54 of the substrate, where the background areas of the top surface 54 are superhydrophobic. A superhydrophilic reservoir 60 is also disposed on the bottom surface 56 opposite the reservoir 60 on the top surface 54. The rest of the bottom surface 56 is superhydrophobic. Liquid 20 is deposited on the first surface 54 at the narrow end 42 of the transport element 40. A Laplace pressure gradient is invoked to transport liquid directionally along the transport element 40 to the reservoir 60 also positioned on the top surface 54. The liquid passes through the substrate 50 to contact the bottom surface reservoir 60. The liquid is then distributed through gravity-aided pinch-off from the substrate 50 at the bottom surface reservoir 60, which is at a location removed from the original deposition site.

In Case III, a superhydrophilic transport element 40 and reservoir 60 are disposed on the superhydrophobic backgrounds of both the top and the bottom surfaces 54, 56. The transport element 40 and reservoir 60 on the top surface 54 are aligned with the transport element 40 and reservoir 60 on the bottom surface 56. Liquid is deposited on the first surface 54 at the narrow end 42 of the transport element 40. A Laplace pressure gradient is invoked to transport liquid directionally along both transport elements 40 to the reservoirs 60. The liquid can pass through the substrate 50 from the top surface 54 to the bottom surface 56 at any point along the transport element 40 and reservoir 60 eventually to the bottom surface reservoir 60. The liquid is then distributed through gravity-aided pinch-off from the substrate 50 at the bottom surface reservoir 60, which is at a location removed from the original deposition site.

The present disclosure describes transport of liquid in fibrous substrates for different dropwise input flow rates. Previous studies on paper substrates have shown that liquids, when dispensed at one end of a rectangular wettable track (on a non-wetting background), traverse in a particular direction by harnessing the wicking property of the substrate. The present disclosure adds flexibility in manipulating the liquid by directionally transporting the liquid in three dimensions on and within the porous substrate (i.e., along the surface, as well as across its thickness). The wettability contrast between the superhydrophobic and superhydrophilic domains, and the shapes of the wettability-confined tracks on the substrate, are harnessed to control the liquid transport on the open surface. The objective is to accommodate liquid that is dispensed at one point on a substrate and emerges on the other side of the substrate at a distance offset from the original point of injection or disposition.

For an HDPT substrate with a superhydrophobic top and superhydrophilic bottom surfaces (achieved by UV exposure without a photomask) surfaces, a liquid droplet dispensed atop the substrate first penetrates to the bottom surface and then radially wicks underneath, as shown in FIG. 2. This mode of liquid transport is akin to the "passing" mode (Case C in FIG. 1) of the fluid diode. It is noted that lateral transport of the liquid is not achieved in this case, rather the liquid emerges from the bottom side and upon further accumulation of liquid from the top, pinches off on the underside of the dispensing location.

A more complex mode of transport is observed on the design configurations shown in FIG. 3, where the vertical directional transport (penetration to the other side of the HDPT) is coupled with rapid, directional (lateral) transport along the wedge-shaped track or transport element, as driven by Laplace pressure gradient. When a wedge-shaped superhydrophilic transport element is laid on the superhydrophobic background of the surface, a sharp wettability contrast is established. Liquid dispensed (or accumulated due to permeation from the other side of the substrate) remains confined within the wettability contrast line and forms an asymmetric liquid bulge on the track. The resulting curvature of the liquid meniscus creates a Laplace pressure gradient, leading to a rapid, planar, unidirectional transport of the liquid from the narrower to the wider end of the wedge-shaped transport element. The different design configurations discussed in FIG. 3 show varying rates at which liquid is transported horizontally (on the air side) and vertically (through the substrate).

The vertical transport is dependent on the z-direction penetration pressure, whereas the lateral (x-y) transport is governed by the Laplace pressure gradient formed from the curvature of the liquid/gas interface. In Case I, the top surface 54 is entirely superhydrophobic, whereas a superhydrophilic, wedge-shaped transport element 40 is laid at the bottom 56 in a superhydrophobic background. A wide circular superhydrophilic region or reservoir 60 is disposed at the end of the wedge-shaped transport element 40 to facilitate liquid accumulation and disposal (by pinch-off when liquid accumulates there). In Cases II and III, a superhydrophilic wedge-shaped transport element 40 is present at the top surface 54 whereas the bottom surface 56 is rendered superhydrophilic at desired regions (FIG. 3). For Case II, the bottom surface 56 is made superhydrophilic only under the circular reservoir 60. In Case III, the bottom surface 56 has a superhydrophilic, wedge-shaped transport element 40 and a reservoir 60 aligned with those on the top surface 54.

Figure 4:
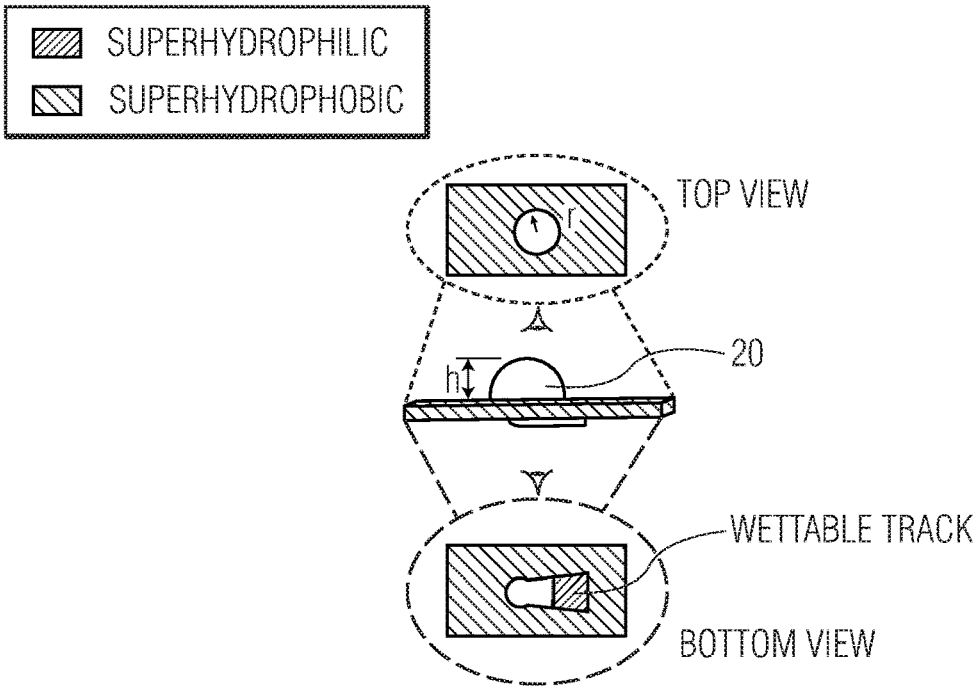
FIG. 4 graphically illustrates the radius and height of a droplet measured from the top, side, and bottom views, respectively, where the bottom view shows the droplet emerging at the beginning of a wettable wedge-shaped transport element.
Figure 5:
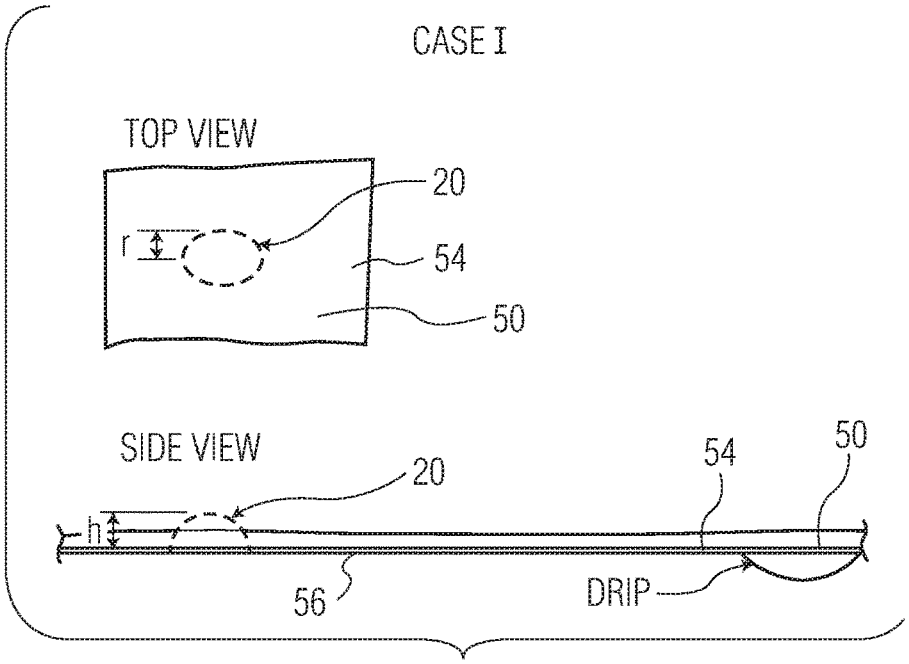
FIG. 5 schematically illustrates the top and side views of a typical Case I transport event in which a water droplet (0.1 ml) is dispensed at the left end of the wedge-shaped transport element, and after penetrating through to the opposite (bottom) side, traverses to the right where it accumulates and eventually drips from a reservoir (the scale bar denotes 1 cm)

FIG. 4 illustrates the radius and height of a droplet 20 measured from the top and side views, respectively. FIG. 5 illustrates the top and side view of a typical Case I transport event. Water droplets 20 (0.1 ml) are dispensed at the narrow end 42 of the wedge-shaped transport element 40, and after penetrating through to the opposite (bottom) side 56, they traverse toward the wide end 45 where they accumulate and eventually drip from the reservoir 60. The scale bar denotes 1 cm.

In Case I, when liquid 20 is deposited on the top surface 54 of the substrate 56 opposite the narrow end 42 of the wedge-shaped transport element 40 (on the bottom surface 56), the droplet gradually gets sucked into the substrate 50. Once the drop emerges at the narrow end 42 of the wedge-shaped transport element 40 on the bottom surface 56, it gets laterally transported to the wide end 45 because of the Laplace pressure gradient formed there. When the droplet penetrates the substrate 50, the time-varying droplet radius (r) and height (h) are measured from the top and side views respectively, as shown in FIG. 4.

Figure 6:
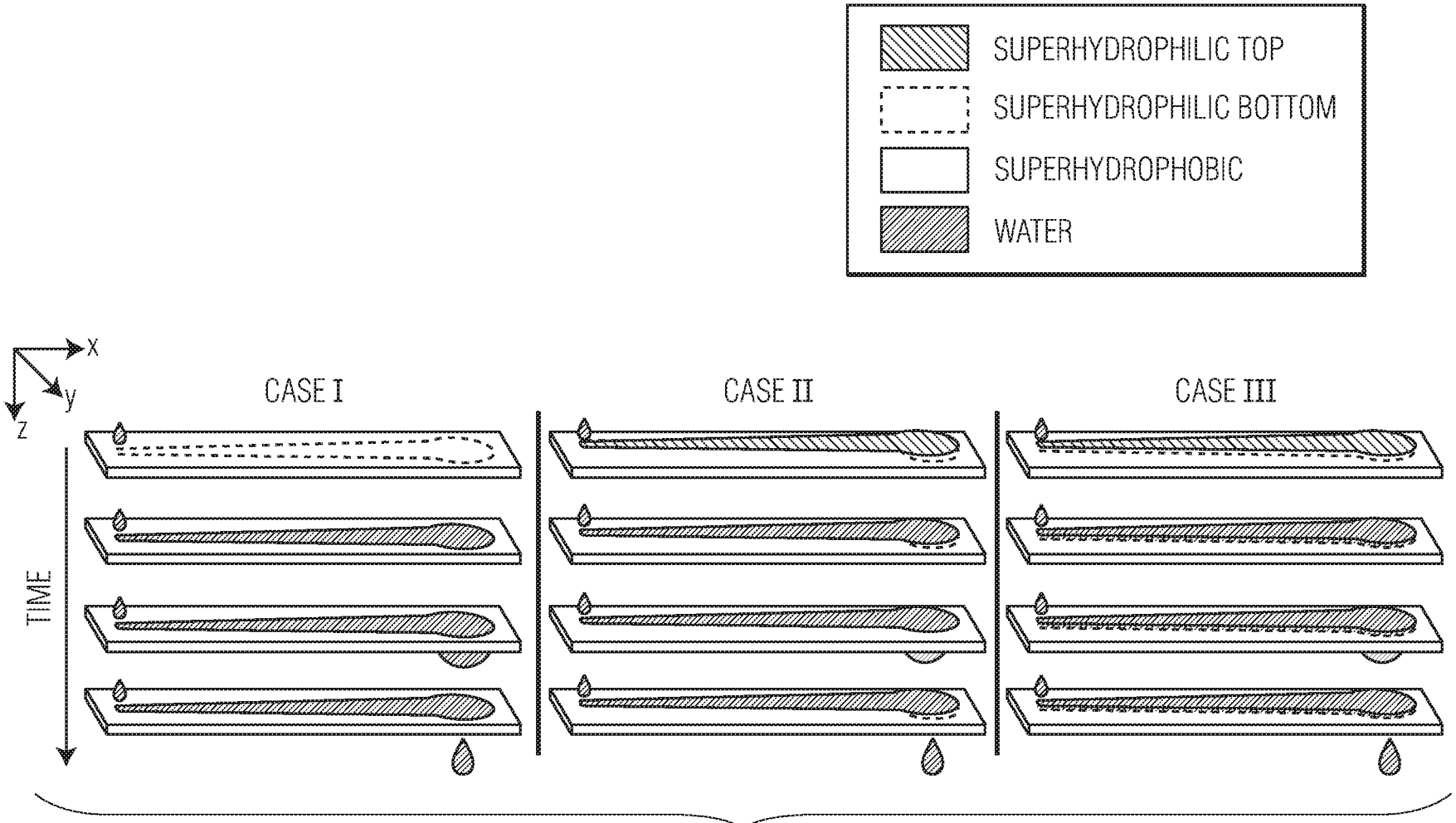
FIG. 6 graphically illustrates liquid transport and dispensing mechanisms from porous materials for different wettability design configurations.

Along with liquid transport, the dripping of liquid from a particular position is monitored by including a reservoir 60 at the desired location. The wedge-shaped transport element 40 helps in transporting the liquid, which gets accumulated at the reservoir end 60 of the wedge-shaped transport element 40 in the form of a pendant liquid drop. The hanging drop eventually gets detached from the substrate 50 when the weight of the accumulated liquid exceeds the surface tension force. Dripping of liquid is observed for all Cases (I, II, and III in FIG. 3), but dripping events qualitatively differ in the following ways (see FIG. 6, in which element numbers that follow those of FIG. 3 are omitted for clarity):

1) In Case I, liquid penetrates through the thickness of the substrate 50 at the dispensing point. The liquid is transported to the bottom surface 56 of the substrate 50 because of the lower penetration pressure it is able to overcome (Case C in FIG. 1). Underneath the substrate 50, at the narrow end 42 of the wedge-shaped transport element 40, the liquid experiences a Laplace pressure gradient that transports it to the wide end 45 of the wedge-shaped transport element 40, which is the right end in FIGS. 3 and 6. The reservoir end 60 of the transport element 40 acts as temporary storage because of its increased liquid holding capacity. With increased accumulation of liquid volume in the reservoir 60, the droplet pinches off under its own weight.

2) In Case II, liquid first transports laterally on the top wedge-shaped transport element 40 to the wide end reservoir 60 and then penetrates through the substrate 50 to the bottom side 56; the accumulated liquid pinches off from the bottom surface reservoir 60. In this case, the liquid is dispensed on a region that has superhydrophilic top 54 and superhydrophobic bottom surface 56. Because the Laplace pressure exerted by the liquid bulge on the top reservoir 60 falls short of the high penetration pressure the droplet needs to overcome (Case B in FIG. 1) to permeate to the other side, the liquid cannot penetrate to the lower surface 56 at the dispensing location. At the same time, the horizontal Laplace pressure gradient is at play, and as a result the liquid gets pumplessly transported to the wide end 45 of the wedge-shaped transport element 40 over the top surface 54 of the substrate 50. With increased accumulation atop the circular reservoir 60, the weight and the Laplace pressure of the liquid bulge eventually overcome the hydrohead barrier pressure resulting in penetration of the liquid to the bottom surface 56 and eventual dripping.

3) In Case III, both the top and bottom surfaces 54, 56 have wedge-shaped transport elements 40 aligned with each other such that each surface 54, 56 is a mirror image of the other. Because both transport elements 40 have been exposed to UV, the substrate 50 has become superhydrophilic throughout the entire depth along the wedge-shaped transport element 40. Thus, the liquid is transported to the wide end 45 as a film. Similar to the previous cases, with increased weight of the hanging drop, it eventually pinches off.

Table 1 shows the time for different intermediate steps for the liquid to reach the wide end 45 of the transport element 40 and drip from the bottom side 56 of the substrate 50. For the same volume of liquid deposited atop the substrate 50 at the narrow end 42 of the wedge-shaped transport element 40, the liquid reaches the wide end 45 of the wedge-shaped transport element 40 faster in Case II than in Case I or III. This happens because in Case II, permeation to the bottom surface 56 happens at a later stage only from the end reservoir 60, which is superhydrophilic from both sides. However, the large liquid pool (which has relatively small curvature) formed on the end reservoir 60 exerts a small Laplace pressure—this leads to a relatively lower permeation rate. Hence, for Case II, dripping from the end reservoir 60 starts later than for Cases I or III. In Case I, the liquid overcomes lower hydrohead at the dispensing point (point C in FIG. 1) and gets sucked in rapidly. Pinch-off happens from the bottom surface 56 after transport of the liquid to the wide end 45. In Case III, the wedge-shaped transport element 40 is superhydrophilic throughout the depth of the substrate 50 because of UV exposure from both sides. Hence, liquid transports to the wide end 45 of the transport element 40 as a liquid film with thickness comparable to the thickness of the substrate 50. Because a large volume of liquid transports through the element in Case III, the wedge-shaped transport element 40 requires more time to get wet. Thus, using different design configurations, liquid can be transported on and through porous substrates 50 at different rates.

TABLE 1

Time required for the liquid to complete different stages of the procedure (all time periods listed in seconds, and from the time liquid is deposited atop the surface)

| Case | Time to wet track length | Time for first drop to emerge from bottom end reservoir | Time for first droplet to drip from end reservoir |
|---|---|---|---|
| I | 32.2 | 41.6 | 58.3 |
| II | 29.7 | 45.2 | 65.6 |
| III | 37.1 | 40.6 | 56.5 |

The technology described herein achieves pumpless and directional liquid transport in three dimensions within thin porous materials. The technology allows liquid volumes that are deposited on one side of a porous material to be dispensed from another location on the opposite side and at distances of the order of centimeters from the original location. Apart from standard wicking mechanisms of transporting liquid across a porous substrate, the current technology leverages wettability-contrast patterns on the surface to invoke Laplace pressure gradients to rapidly transport the liquid directionally along the upper or lower surface of the porous substrate. Also, by implementing a widened patch of superhydrophilic region (the reservoir), the liquid is disposed from the substrate from a desired location away from the original spot. Three different designs are described that transport liquid either on and through, or through and under a porous substrate. Two of the designs feature liquid-dispensing ability from a desired location, whereas one of the configurations possesses the advantage of liquid transport only at the bottom surface, keeping the top surface dry. The present wettability-controlled designs can be used as fundamental blocks of any pumpless liquid manipulating system using porous substrates.

The technology described herein combines directed lateral and bulk transport of liquids over the surface of, and through the bulk of a porous substrate, respectively. The volume of the dispensed liquid is well-controlled, both spatially and temporally. With suitable modifications in the design (described as Cases I, II, III), it is also possible to precisely control the lateral transport over the top, bottom, or both surfaces of the substrate. By altering the extent of the lateral spread, the residence time of the liquid on or under the substrate can be controlled. The overall transport rate can be controlled by adjusting the substrate porosity.

In practice until recently, the fabrication of super-repellent composites requiring polymers with sufficiently low surface energies (i.e., for repelling water, $\gamma << 72$ mN/m) demanded the use of harsh solvents for wet-processing, thus hindering the development of entirely water-based systems. Fluorine-free and water-compatible polymer systems capable of delivering low surface energy have been the primary challenge for the development of truly environmentally-benign superhydrophobic coatings. A low surface energy, water-borne fluoropolymer dispersion (DuPont Capstone ST-100) was used in a water-based superhydrophobic spray, where the correlation between contact angle and hydrostatic resistance was studied, but again, the presence of fluorinated compounds in the composite still posed environmental concerns. At one point the EPA initiated a reduction in the manufacture of many dangerous fluoropolymer compounds; such compounds have a high risk of breaking down into perfluorooctanoic acids (PFOA) and can have an extremely adverse environmental impact. PFOA, a known cause of birth defects, can enter into ground water, polluting reservoirs and aquatic wild-life, eventually being ingested by humans where it can accumulate to hazardous levels. Although short-chain fluoropolymers made in response to the EPA initiative, such as DuPont's Capstone ST-100, are available and pose less environmental risk; eliminating the necessity of fluorine altogether for super-repellency has been a primary goal of this work; it is hoped that one day, such fluorinated composites can be made obsolete, being replaced by more environmentally-conscious, so-called 'green' alternatives.

Choosing particles having nano-scale dimensions allows for fine control over surface roughness and a greater reduction in the liquid-to-solid interfacial contact area; for hydrophobic, or low-surface energy surfaces, this translates into an increased resistance to liquid wetting by allowing the solid surface to retain pockets of vapor that limit liquid/solid contact. Many superhydrophobic surfaces fabricated in the literature have utilized hydrophobic particle fillers, necessitating the use of non-aqueous suspensions or other additives. Although these hydrophobic particles aided in generating the repellent roughness, they are not viable in a water-based system without the use of charge-stabilization or surfactants. The hydrophilic nanoparticle $TiO_2$ is demonstrated to supply an adequate amount of surface roughness, and is compatible with a waterborne polyolefin polymer wax blend; the polymer acts to conceal the hydrophilicity of suspended $TiO_2$ particles when dispersed, thus sheathing the nanoparticles in a weakly hydrophobic shell that is maintained once the final composite film has been applied and residual water is removed. Using nanoparticles of extremely small dimensions (<25 nm), a surface roughness is achieved propelling the contact angles of the final composite upwards into the superhydrophobic regime. In addition, $TiO_2$ has been shown to be a non-toxic additive to food, skin lotions, and paint pigments, thereby further strengthening the claim of reduced impact, environmentally or otherwise, from the composite constituents.

The superhydrophilic/superhydrophobic patterns described herein can be applied using any suitable coating formulations, including non-fluorinated formulations such as those described in PCT Patent Application Publication Nos. WO2016/138272 and WO2016/138277 and fluorinated formulations such as those described in U.S. Pat. No. 9,217,094.

The present disclosure relates to a surface of a substrate, or the substrate itself, exhibiting superhydrophobic characteristics when treated with a formulation including a hydrophobic component, a filler particle, and water. The superhydrophobicity can be applied either over the entire surface, patterned throughout or on the substrate material, and/or directly penetrated through the z-directional thickness of the substrate material.

In some aspects of the present disclosure, the substrate that is treated is a nonwoven web. In other aspects, the substrate is a tissue product.

The substrate of the present disclosure can be treated such that it is superhydrophobic throughout the z-directional thickness of the material and is controlled in such a way that only certain areas of the material are superhydrophobic. Such treatment can be designed to control spatial wettability of the material thereby directing wetting and liquid penetration of the material; such designs can be utilized in controlling liquid transport and flow rectification.

Suitable substrates of the present disclosure can include a nonwoven fabric, woven fabric, knit fabric, or laminates of these materials. The substrate can also be a tissue or towel, as described herein. Materials and processes suitable for forming such substrate are generally well known to those skilled in the art. For instance, some examples of nonwoven fabrics that can be used in the present disclosure include, but are not limited to, spunbonded webs, meltblown webs, bonded carded webs, air-laid webs, coform webs, spunlace nonwoven webs, hydraulically entangled webs, and the like. In each case, at least one of the fibers used to prepare the nonwoven fabric is a thermoplastic material containing fiber. In addition, nonwoven fabrics can be a combination of thermoplastic fibers and natural fibers, such as, for example, cellulosic fibers (softwood pulp, hardwood pulp, thermomechanical pulp, etc.). Generally, from the standpoint of cost and desired properties, the substrate of the present disclosure is a nonwoven fabric.

If desired, the nonwoven fabric can also be bonded using techniques well known in the art to improve the durability, strength, hand, aesthetics, texture, and/or other properties of the fabric. For instance, the nonwoven fabric can be thermally (e.g., pattern bonded, through-air dried), ultrasonically, adhesively and/or mechanically (e.g. needled) bonded. For instance, various pattern bonding techniques are described in U.S. Pat. No. 3,855,046 to Hansen; U.S. Pat. No. 5,620,779 to Levy, et al.; U.S. Pat. No. 5,962,112 to Haynes, et al.; U.S. Pat. No. 6,093,665 to Sayovitz, et al.; U.S. Design Pat. No. 428,267 to Romano, et al.; and U.S. Design Pat. No. 390,708 to Brown.

In another aspect, the substrate of the present disclosure is formed from a spunbonded web containing monocomponent and/or multicomponent fibers. Multicomponent fibers are fibers that have been formed from at least two polymer components. Such fibers are usually extruded from separate extruders but spun together to form one fiber. The polymers of the respective components are usually different from each other, although multicomponent fibers can include separate components of similar or identical polymeric materials. The individual components are typically arranged in distinct zones across the cross-section of the fiber and extend substantially along the entire length of the fiber. The configuration of such fibers can be, for example, a side-by-side arrangement, a pie arrangement, or any other arrangement.

When utilized, multicomponent fibers can also be splittable. In fabricating multicomponent fibers that are splittable, the individual segments that collectively form the unitary multicomponent fiber are contiguous along the longitudinal direction of the multicomponent fiber in a manner such that one or more segments form part of the outer surface of the unitary multicomponent fiber. In other words, one or more segments are exposed along the outer perimeter of the multicomponent fiber. For example, splittable multicomponent fibers and methods for making such fibers are described in U.S. Pat. No. 5,935,883 to Pike and U.S. Pat. No. 6,200,669 to Marmon, et al.

The substrate of the present disclosure can also contain a coform material. The term "coform material" generally refers to composite materials including a mixture or stabilized matrix of thermoplastic fibers and a second non-thermoplastic material. As an example, coform materials can be made by a process in which at least one meltblown die head is arranged near a chute through which other materials are added to the web while it is forming. Such other materials can include, but are not limited to, fibrous organic materials, such as woody or non-woody pulp such as cotton, rayon, recycled paper, pulp fluff and also superabsorbent particles, inorganic absorbent materials, treated polymeric staple fibers and the like. Some examples of such coform materials are disclosed in U.S. Pat. No. 4,100,324 to Anderson, et al.; U.S. Pat. No. 5,284,703 to Everhart, et al.; and U.S. Pat. No. 5,350,624 to Georger, et al.

Additionally, the substrate can also be formed from a material that is imparted with texture on one or more surfaces. For instance, in some aspects, the substrate can be formed from a dual-textured spunbond or meltblown material, such as described in U.S. Pat. No. 4,659,609 to Lamers, et al. and U.S. Pat. No. 4,833,003 to Win, et al.

In one particular aspect of the present disclosure, the substrate is formed from a hydroentangled nonwoven fabric. Hydroentangling processes and hydroentangled composite webs containing various combinations of different fibers are known in the art. A typical hydroentangling process utilizes high pressure jet streams of water to entangle fibers and/or filaments to form a highly entangled consolidated fibrous structure, e.g., a nonwoven fabric. Hydroentangled nonwoven fabrics of staple length fibers and continuous filaments are disclosed, for example, in U.S. Pat. No. 3,494,821 to Evans and U.S. Pat. No. 4,144,370 to Boulton. Hydroentangled composite nonwoven fabrics of a continuous filament nonwoven web and a pulp layer are disclosed, for example, in U.S. Pat. No. 5,284,703 to Everhart, et al. and U.S. Pat. No. 6,315,864 to Anderson, et al.

Of these nonwoven fabrics, hydroentangled nonwoven webs with staple fibers entangled with thermoplastic fibers is especially suited as the substrate. In one particular example of a hydroentangled nonwoven web, the staple fibers are hydraulically entangled with substantially continuous thermoplastic fibers. The staple can be cellulosic staple fiber, non-cellulosic stable fibers or a mixture thereof. Suitable non-cellulosic staple fibers includes thermoplastic staple fibers, such as polyolefin staple fibers, polyester staple fibers, nylon staple fibers, polyvinyl acetate staple fibers, and the like or mixtures thereof. Suitable cellulosic staple fibers include for example, pulp, thermomechanical pulp, synthetic cellulosic fibers, modified cellulosic fibers, and the like. Cellulosic fibers can be obtained from secondary or recycled sources. Some examples of suitable cellulosic fiber sources include virgin wood fibers, such as thermomechanical, bleached and unbleached softwood and hardwood pulps. Secondary or recycled cellulosic fibers obtained from office waste, newsprint, brown paper stock, paperboard scrap, etc., can also be used. Further, vegetable fibers, such as abaca, flax, milkweed, cotton, modified cotton, cotton linters, can also be used as the cellulosic fibers. In addition, synthetic cellulosic fibers such as, for example, rayon and viscose rayon can be used. Modified cellulosic fibers are generally composed of derivatives of cellulose formed by substitution of appropriate radicals (e.g., carboxyl, alkyl, acetate, nitrate, etc.) for hydroxyl groups along the carbon chain.

One particularly suitable hydroentangled nonwoven web is a nonwoven web composite of polypropylene spunbond fibers, which are substantially continuous fibers, having pulp fibers hydraulically entangled with the spunbond fibers. Another particularly suitable hydroentangled nonwoven web is a nonwoven web composite of polypropylene spunbond fibers having a mixture of cellulosic and non-cellulosic staple fibers hydraulically entangled with the spunbond fibers.

The substrate of the present disclosure can be prepared solely from thermoplastic fibers or can contain both thermoplastic fibers and non-thermoplastic fibers. Generally, when the substrate contains both thermoplastic fibers and non-thermoplastic fibers, the thermoplastic fibers make up from about 10% to about 90%, by weight of the substrate. In a particular aspect, the substrate contains between about 10% and about 30%, by weight, thermoplastic fibers.

Generally, a nonwoven substrate will have a basis weight in the range of about 5 gsm (grams per square meter) to about 200 gsm, more typically, between about 33 gsm to about 200 gsm. The actual basis weight can be higher than 200 gsm, but for many applications, the basis weight will be in the 33 gsm to 150 gsm range.

The thermoplastic materials or fibers, making-up at least a portion of the substrate, can essentially be any thermoplastic polymer. Suitable thermoplastic polymers include polyolefins, polyesters, polyamides, polyurethanes, polyvinylchloride, polytetrafluoroethylene, polystyrene, polyethylene terephthalate, biodegradable polymers such as polylactic acid, and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly(l-butene) and poly(2-butene); polypentene, e.g., poly(l-pentene) and poly (2-pentene); poly(3-methyl-1-pentene); poly(4-methyl 1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polytrimethylene terephthalate, polybutylene terephthalate, polytetramethylene terephthalate, polycyclohexylene-1,4-dimethylene terephthalate, and isophthalate copolymers thereof, as well as blends thereof. These thermoplastic polymers can be used to prepare both substantially continuous fibers and staple fibers, in accordance with the present disclosure.

In another aspect, the substrate can be a tissue product. The tissue product can be of a homogenous or multi-layered construction, and tissue products made therefrom can be of a single-ply or multi-ply construction. The tissue product desirably has a basis weight of about 10 gsm to about 65 gsm, and density of about 0.6 g/cc or less. More desirably, the basis weight will be about 40 gsm or less and the density will be about 0.3 g/cc or less. Most desirably, the density will be about 0.04 g/cc to about 0.2 g/cc. Unless otherwise specified, all amounts and weights relative to the paper are on a dry basis. Tensile strengths in the machine direction can be in the range of from about 100 to about 5,000 grams per inch of width. Tensile strengths in the cross-machine direction are from about 50 grams to about 2,500 grams per inch of width. Absorbency is typically from about 5 grams of water per gram of fiber to about 9 grams of water per gram of fiber.

Conventionally pressed tissue products and methods for making such products are well known in the art. Tissue products are typically made by depositing a papermaking furnish on a foraminous forming wire, often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided from a pressurized headbox, which has an opening for delivering a thin deposit of pulp furnish onto the Fourdrinier wire to form a wet web. The web is then typically dewatered to a fiber consistency of from about 7% to about 25% (total web weight basis) by vacuum dewatering and further dried by pressing operations wherein the web is subjected to pressure developed by opposing mechanical members, for example, cylindrical rolls. The dewatered web is then further pressed and dried by a steam drum apparatus known in the art as a Yankee dryer. Pressure can be developed at the Yankee dryer by mechanical means such as an opposing cylindrical drum pressing against the web. Multiple Yankee dryer drums can be employed, whereby additional pressing is optionally incurred between the drums. The formed sheets are considered to be compacted because the entire web is subjected to substantial mechanical compressional forces while the fibers are moist and are then dried while in a compressed state.

One particular aspect of the present disclosure utilizes an uncreped through-air-drying technique to form the tissue product. Through-air-drying can increase the bulk and softness of the web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Ruqowski, et al.; U.S. Pat. No. 6,017,417 to Wendt, et al., and U.S. Pat. No. 6,432,270 to Liu, et al. Uncreped through-air-drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-air-drying to remove the water from the fibrous web; and (4) removing the dried fibrous web from the traveling foraminous belt.

Conventional scalable methods, such as spraying, can be used to apply a superhydrophobic coating on a surface. Some technical difficulties are typically encountered when spraying water-based dispersions: The first major problem is insufficient evaporation of the liquid during atomization and a high degree of wetting of the dispersion onto the coated substrate, both resulting in non-uniform coatings due to contact line pinning and the so called "coffee-stain effect" when the water eventually evaporates. The second major challenge is the relatively large surface tension of water when compared with other solvents used for spray coating. Water, due to its high surface tension, tends to form non-uniform films in spray applications, thus requiring great care to ensure that a uniform coating is attained. This is especially critical for hydrophobic substrates where the water tends to bead and roll. It was observed that the best approach for applying the aqueous dispersions of the present disclosure was to produce extremely fine droplets during atomization, and to apply only very thin coatings, so as not to saturate the substrate and re-orient hydrogen bonding within the substrate that, after drying, would cause cellulosic substrates (e.g. paper towel) to become stiff.

In another aspect, the coatings are spray cast first on a substrate, such as standard paperboard or other cellulosic substrate; multiple spray passes are used to achieve different coating thicknesses. The sprayed films are then subjected to drying in an oven at about 80° C. for about 30 min to remove all excess water. Once dried, the coatings are characterized for wettability (i.e., hydrophobic vs. hydrophilic). The substrates can be weighed on a microbalance (Sartorius® LE26P) before and after coating and drying in order to determine the minimum level of coating required to induce superhydrophobicity. This "minimum coating" does not strictly mean that the sample will resist penetration by liquids, but rather that a water droplet will bead on the surface and roll off unimpeded. Liquid repellency of substrates before and after coating can be characterized by a hydrostatic pressure setup that determines liquid penetration pressures (in cm of liquid).

Examples

The following are provided for exemplary purposes to facilitate understanding of the disclosure and should not be construed to limit the disclosure to the examples. Other formulations and substrates can be used within this disclosure and the claims presented below.

In a specific example, a porous substrate in the form of high-density paper towel (HDPT) KLEENEX 50606 brand hard roll towels at 38 gsm, available from Kimberly-Clark, was coated with $TiO_2$ filler particles in a hydrophobic fluoroacrylic polymer (PMC) (20 wt. % in water; DuPont, Capstone ST-100) matrix using spraying to render the substrate superhydrophobic. A facile patterning technique, which has been deployed previously on solid substrates, was adapted for the HDPT. The surface treatment includes two basic steps:

1. Spray-coating of $TiO_2$ nanoparticles with PMC on the substrate followed by drying in an oven (Model 10GC; Quincy Lab, Inc.) at 80° C. for 2 hours to render the substrate superhydrophobic (CA ~153±3°).
2. Exposing the surface selectively to UV radiation (390 nm, exposure time~60 minutes) to render superhydrophilicity (CA<5°) on the exposed regions under a photomask.

In a first particular aspect, a material for manipulating liquid volumes includes a porous substrate having first and second surfaces; and a wedge-shaped transport element disposed on one of the first and second surfaces, wherein the wedge-shaped transport element has a narrow end and a wide end, wherein the wide end is connected to a first reservoir, wherein the wedge-shaped transport element is configured to pass liquid from the narrow end to the wide end to the first reservoir, regardless of gravity, and wherein the first reservoir is configured to pass liquid away from the substrate in a z-direction opposite from the surface on which a liquid is deposited, wherein the surface on which the wedge-shaped transport element is disposed is one of hydrophobic or superhydrophobic, and wherein the wedge-shaped transport element is one of a) superhydrophilic when the first surface is hydrophobic, b) superhydrophilic when the first surface is superhydrophobic, and c) hydrophilic when the first surface is superhydrophobic.

A second particular aspect includes the first particular aspect, wherein the wedge-shaped transport element and the first reservoir are disposed on the second surface, and wherein the substrate is configured to receive liquid on the first surface opposite the narrow end of the wedge-shaped transport element.

A third particular aspect includes the first and/or second aspect, wherein the liquid passed on the wedge-shaped transport element is Laplace-pressure driven.

A fourth particular aspect includes one or more of aspects 1-3, wherein the porous substrate includes a hydrophobic or superhydrophobic treatment.

A fifth particular aspect includes one or more of aspects 1-4, wherein the wedge-shaped transport element includes a localized hydrophilic or superhydrophilic treatment.

A sixth particular aspect includes one or more of aspects 1-5, wherein the wedge-shaped transport element and the first reservoir are disposed on the first surface.

A seventh particular aspect includes one or more of aspects 1-6, further comprising a second wedge-shaped transport element and a second reservoir disposed on the second surface.

An eighth particular aspect includes one or more of aspects 1-7, wherein the substrate is configured to receive liquid on the first surface at the narrow end of the wedge-shaped transport element.

A ninth particular aspect includes one or more of aspects 1-8, wherein the wedge-shaped transport element and the first reservoir are disposed on the first surface, further comprising a second reservoir disposed on the second surface opposite the first reservoir.

A tenth particular aspect includes one or more of aspects 1-9, wherein the substrate is configured to receive liquid on the first surface at the narrow end of the wedge-shaped transport element.

An eleventh particular aspect includes one or more of aspects 1-10, wherein the porous substrate is a nonwoven.

In a twelfth particular aspect, a material for manipulating liquid volumes includes a porous substrate having first and second surfaces; and a wedge-shaped transport element disposed on the second surface, wherein the wedge-shaped transport element has a narrow end and a wide end, wherein the wide end is connected to a reservoir disposed on the second surface, wherein the wedge-shaped transport element is configured to pass liquid from the narrow end to the wide end to the reservoir, regardless of gravity, and wherein the reservoir is configured to pass liquid away from the substrate in a z-direction opposite from the surface on which a liquid is deposited, wherein the second surface is one of hydrophobic or superhydrophobic, and wherein the wedge-shaped transport element is one of a) superhydrophilic when the first surface is hydrophobic, b) superhydrophilic when the first surface is superhydrophobic, and c) hydrophilic when the first surface is superhydrophobic.

A thirteenth particular aspect includes the twelfth particular aspect, wherein the substrate is configured to receive liquid on the first surface opposite the narrow end of the wedge-shaped transport element.

In a fourteenth particular includes the twelfth and/or thirteenth aspect, wherein the liquid passed on the wedge-shaped transport element is Laplace-pressure driven.

A fifteenth particular aspect includes one or more of aspects 12-14, wherein the porous substrate includes a hydrophobic or superhydrophobic treatment.

A sixteenth particular aspect includes one or more of aspects 12-15, wherein the wedge-shaped transport element includes a localized hydrophilic or superhydrophilic treatment.

In a seventeenth particular aspect, a material for manipulating liquid volumes includes a porous substrate having first and second surfaces, wherein the first surface includes a treatment rendering the first surface hydrophobic or superhydrophobic; and a wedge-shaped transport element disposed on the second surface, wherein the wedge-shaped transport element has a narrow end and a wide end, wherein the wide end is connected to a reservoir disposed on the second surface, wherein the substrate is configured to receive liquid on the first surface opposite the narrow end of the wedge-shaped transport element, wherein the wedge-shaped transport element is configured to pass liquid from the narrow end to the wide end to the reservoir, regardless of gravity, and wherein the reservoir is configured to pass liquid away from the substrate in a z-direction opposite from the surface on which a liquid is deposited, wherein the wedge-shaped transport element is one of a) superhydrophilic when the first surface is hydrophobic, b) superhydrophilic when the first surface is superhydrophobic, and c) hydrophilic when the first surface is superhydrophobic.

An eighteenth particular aspect includes the seventeenth particular aspect, wherein the porous substrate is a nonwoven.

A nineteenth particular aspect includes seventeenth and/or eighteenth aspects, wherein the reservoir includes a superhydrophilic treatment.

A twentieth particular aspect includes one or more of aspects 17-19, further comprising a second wedge-shaped transport element and a second reservoir disposed on the first surface.

All documents cited herein are, in relevant part, incorporated herein by reference; the citation of any document is not to be construed as an admission that it is prior art with respect to the present disclosure. To the extent that any meaning or definition of a term in this document conflicts with any meaning or definition of the same term in a document incorporated by reference, the meaning or definition assigned to that term in this document shall govern.

While particular aspects of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A material for manipulating liquid volumes, the material comprising:

a porous substrate having first and second surfaces; and a wedge-shaped transport element disposed on one of the first and second surfaces, wherein the wedge-shaped transport element has a narrow end and a wide end, wherein the wide end is connected to a first reservoir, wherein the wedge-shaped transport element is configured to pass liquid from the narrow end to the wide end to the first reservoir, regardless of gravity, and wherein the first reservoir is configured to pass liquid away from the substrate in a z-direction opposite from the surface on which a liquid is deposited, wherein the surface on which the wedge-shaped transport element is disposed is one of hydrophobic or superhydrophobic, and wherein the wedge-shaped transport element is one of a) superhydrophilic when the first surface is hydrophobic, b) superhydrophilic when the first surface is superhydrophobic, and c) hydrophilic when the first surface is superhydrophobic;

wherein the wedge-shaped transport element and the first reservoir are disposed on the second surface, and wherein the substrate is configured to receive liquid on the first surface opposite the narrow end of the wedge-shaped transport element, wherein the liquid passed on the wedge-shaped transport element is Laplace-pressure driven by wettability-contrast patterns on the surface on which the wedge-shaped transport element is disposed.

2. The material of claim 1, wherein the porous substrate includes a hydrophobic or superhydrophobic treatment.

3. The material of claim 1, wherein the wedge-shaped transport element includes a localized hydrophilic or superhydrophilic treatment.

4. The material of claim 1, further comprising a second wedge-shaped transport element and a second reservoir disposed on the second surface.

5. The material of claim 1, wherein the porous substrate is a nonwoven.

6. A material for manipulating liquid volumes, the material comprising:

a porous substrate having first and second surfaces; and a wedge-shaped transport element disposed on the second surface, wherein the wedge-shaped transport element has a narrow end and a wide end, wherein the wide end is connected to a reservoir disposed on the second surface, wherein the wedge-shaped transport element is configured to pass liquid from the narrow end to the wide end to the reservoir, regardless of gravity, and wherein the reservoir is configured to pass liquid away from the substrate in a z-direction opposite from the surface on which a liquid is deposited, wherein the liquid passed on the wedge-shaped transport element is Laplace-pressure driven by wettability-contrast patterns on the second surface on which the wedge-shaped transport element is disposed, wherein the second surface is one of hydrophobic or superhydrophobic, and wherein the wedge-shaped transport element is one of a) superhydrophilic when the first surface is hydrophobic, b) superhydrophilic when the first surface is superhydrophobic, and c) hydrophilic when the first surface is superhydrophobic;

wherein the substrate is configured to receive liquid on the first surface opposite the narrow end of the wedge-shaped transport element.

7. The material of claim 6, wherein the porous substrate includes a hydrophobic or superhydrophobic treatment.

8. The material of claim 6, wherein the wedge-shaped transport element includes a localized hydrophilic or superhydrophilic treatment.

9. A material for manipulating liquid volumes, the material comprising:

a porous substrate having first and second surfaces, wherein the first surface includes a treatment rendering the first surface hydrophobic or superhydrophobic; and a wedge-shaped transport element disposed on the second surface, wherein the wedge-shaped transport element has a narrow end and a wide end, wherein the wide end is connected to a reservoir disposed on the second surface, wherein the substrate is configured to receive liquid on the first surface opposite the narrow end of the wedge-shaped transport element, wherein the wedge-shaped transport element is configured to pass liquid from the narrow end to the wide end to the reservoir, regardless of gravity, and wherein the reservoir is configured to pass liquid away from the substrate in a z-direction opposite from the surface on which a liquid is deposited, wherein the liquid passed on the wedge-shaped transport element is Laplace-pressure driven by wettability-contrast patterns on the second surface on which the wedge-shaped transport element is disposed, wherein the wedge-shaped transport element is one of a) superhydrophilic when the first surface is hydrophobic, b) superhydrophilic when the first surface is superhydrophobic, and c) hydrophilic when the first surface is superhydrophobic.

10. The material of claim 9, wherein the porous substrate is a nonwoven.

11. The material of claim 9, wherein the reservoir includes a superhydrophilic treatment.

12. The material of claim 9, further comprising a second wedge-shaped transport element and a second reservoir disposed on the first surface.

* * * * *